US005093309A

United States Patent [19]

Hart et al.

[11] Patent Number: 5,093,309

[45] Date of Patent: Mar. 3, 1992

[54] RECEIVER SHEET

[75] Inventors: Charles R. Hart; John Francis, both of Yarm; Mark D. H. Jefferson, Billingham, all of England

[73] Assignee: Imperial Chemical Industries PLC, London, England

[21] Appl. No.: 378,788

[22] Filed: Jul. 12, 1989

[30] Foreign Application Priority Data

Jul. 12, 1988 [GB] United Kingdom ..... 8816520

[51] Int. Cl.[5] ..... B41M 5/035; B41M 5/26

[52] U.S. Cl. ..... 503/227; 8/471; 427/152; 428/195; 428/323; 428/329; 428/330; 428/331; 428/480; 428/500; 428/910; 428/913; 428/914

[58] Field of Search ..... 8/471; 428/195, 323, 428/913, 914, 328-331, 480, 500, 910; 503/227; 427/146, 152

[56] References Cited

FOREIGN PATENT DOCUMENTS

| | | | |
|---|---|---|---|
| 0138483 | 4/1985 | European Pat. Off. | 503/227 |
| 0194016 | 9/1986 | European Pat. Off. | 503/227 |
| 0234563 | 9/1987 | European Pat. Off. | 503/227 |
| 0316929 | 5/1989 | European Pat. Off. | 503/227 |

OTHER PUBLICATIONS

European Search Report, Application No. 89 30 6271.

*Primary Examiner*—Bruce H. Hess
*Attorney, Agent, or Firm*—Cushman, Darby & Cushman

[57] ABSTRACT

A TTP receiver sheet having a backing layer comprising a polymeric resin binder and a non-film forming inert particulate material of mean particle size from 5 to 250 nm.

13 Claims, 1 Drawing Sheet

RECEIVER SHEET

BACKGROUND OF THE INVENTION a) Technical Field of Invention

This invention relates to thermal transfer printing and, in particular, to a thermal transfer printing receiver sheet for use with an associated donor sheet.

b) Background of the Art

Currently available thermal transfer printing (TTP) techniques generally involve the generation of an image on a receiver sheet by thermal transfer of an imaging medium from an associated donor sheet. The donor sheet typically comprises a supporting substrate of paper, synthetic paper or a polymeric film material coated with a transfer layer comprising a sublimable dye incorporated in an ink medium usually comprising a wax and/or a polymeric resin binder. The associated receiver sheet usually comprises a supporting substrate, of a similar material, having on a surface thereof a dye-receptive, polymeric receiving layer. When an assembly, comprising a donor and a receiver sheet positioned with the respective transfer and receiving layers in contact, is selectively heated in a patterned area derived, for example—from an information signal, such as a television signal, dye is transferred from the donor sheet to the dye-receptive layer of the receiver sheet to form therein a monochrome image of the specified pattern. By repeating the process with different monochrome dyes, usually cyan, magenta and yellow, a full coloured image is produced on the receiver sheet. Image production, therefore, depends on dye diffusion by thermal transfer.

To facilitate separation of the imaged sheet from the heated assembly, at least one of the transfer layer and receiving layer may be associated with a release medium, such as a silicone oil.

Although the intense, localised heating required to effect development of a sharp image may be applied by various techniques, including laser beam imaging, a convenient and widely employed technique of thermal printing involves a thermal print-head, for example, of the dot matrix variety in which each dot is represented by an independent heating element (electronically controlled, if desired).

Receiver sheets for receipt of an image are conveniently stacked in a storage magazine adjacent to the print-head. In practice, problems are encountered in separating individual receiver sheets from the stack for smooth, sequential feeding to the print-head.

c) The Prior Art

Various receiver sheets have been proposed for use in TTP processes. For example, EP-A-0194106 discloses a heat transferable sheet having a substrate and an image-receiving layer thereon, with an intermediate layer between the substrate and receiving layer. A lubricating layer may be provided on the surface of the substrate remote from the receiving layer, and suitably comprises a synthetic resin, such as a methacrylate resin or a vinyl resin.

Even so, the problem of jamming with commercially available receiver sheets is frequently encountered during TTP operations, particularly when the operation requires the continuous sequential feeding of a large number of sheets from a single storage magazine.

We have now devised a receiver sheet for use in a TTP process which overcomes or substantially eliminates the aforementioned problem.

SUMMARY OF THE INVENTION

Accordingly, the present invention provides a thermal transfer printing receiver sheet for use in association with a compatible donor sheet, the receiver sheet comprising a supporting substrate having, on a first surface thereof, a dye-receptive receiving layer to receive a dye thermally transferred from the donor sheet, and, on a second surface thereof, a backing layer comprising a polymeric resin binder and a non-film-forming inert particulate material of mean particle size from 5 to 250 nm.

The invention also provides a method of producing a thermal transfer printing receiver sheet for use in association with a compatible donor sheet, comprising forming a supporting substrate having, on a first surface thereof, a dye-receptive receiving layer to receive a dye thermally transferred from the donor sheet, and, on a second surface thereof, a backing layer comprising a polymeric resin binder and a non-film-forming inert particulate material of mean particle size from 5 to 250 nm.

DETAILED DESCRIPTION AND PREFERRED EMBODIMENTS OF THE INVENTION

Figure 1:
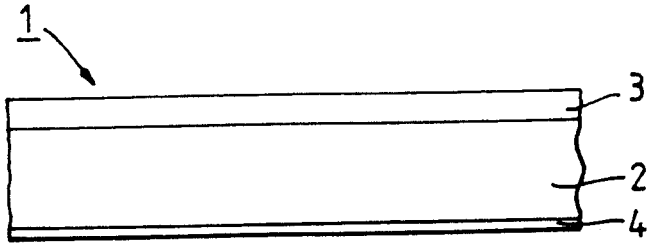

In the context of the invention the following terms are to be understood as having the meanings hereto assigned:

- sheet: includes not only a single, individual sheet, but also a continuous web or ribbon-like structure capable of being sub-divided into a plurality of individual sheets.
- compatible: in relation to a donor sheet, indicates that the donor sheet is impregnated with a dyestuff which is capable of migrating, under the influence of heat, into, and forming an image in, the receiving layer of a receiver sheet placed in contact therewith.
- opaque: means that the substrate of the receiver sheet is substantially impermeable to visible light.
- voided: indicates that the substrate of the receiver sheet comprises a cellular structure containing at least a proportion of discrete, closed cells.
- film: is a self-supporting structure capable of independent existence in the absence of a supporting base.
- antistatic: means that a receiver sheet treated by the application of an antistatic layer exhibits a reduced tendency, relative to an untreated sheet, to accumulate static electricity at the treated surface.

The substrate of a receiver sheet according to the invention may be formed from paper, but preferably from any synthetic, film-forming, polymeric material. Suitable thermoplastics, synthetic, materials include a homopolymer or a copolymer of a 1-olefin, such as ethylene, propylene or butene-1, a polyamide, a polycarbonate, and particularly a synthetic linear polyester which may be obtained by condensing one or more dicarboxylic acids or their lower alkyl (up to 6 carbon atoms) diesters, e.g. terephthalic acid, isophthalic acid, phthalic acid, 2,5-, 2,6- or 2,7-naphthalenedicarboxylic acid, succinic acid, sebacic acid, adipic acid, azelaic acid, 4,4'-diphenyldicarboxylic acid, hexahydro-terephthalic acid or 1,2-bis-p-carboxyphenoxyethane (optionally with a monocarboxylic acid, such as pivalic acid) with one or more glycols, e.g. ethylene glycol, 1,3-propanediol, 1,4-butanediol, neopentyl glycol and 1,4-cyclohaxanedimethanol. A polyethylene terephthalate film is particularly preferred, especially such a film which has been biaxially oriented by sequential stretching in two mutually perpendicular directions, typically at a temperature in the range 70° to 125° C., and preferably heat set, typically at a temperature in the range 150° to 250° C. for example—as described in British patent 838708.

A film substrate for a receiver sheet according to the invention may be uniaxially oriented, but is preferably biaxially oriented by drawing in two mutually perpendicular directions in the plane of the film to achieve a satisfactory combination of mechanical and physical properties. Formation of the film may be effected by any process known in the art for producing an oriented polymeric film—for example, a tubular or flat film process.

In a tubular process simultaneous biaxial orientation may be effected by extruding a thermoplastics polymeric tube which is subsequently quenched, reheated and then expanded by internal gas pressure to induce transverse orientation, and withdrawn at a rate which will induce longitudinal orientation.

In the preferred flat film process a film-forming polymer is extruded through a slot die and rapidly quenched upon a chilled casting drum to ensure that the polymer is quenched to the amorphous state. Orientation is then effected by stretching the quenched extrudate in at least one direction at a temperature above the glass transition temperature of the polymer. Sequential orientation may be effected by stretching a flat, quenched extrudate firstly in one direction, usually the longitudinal direction, i.e. the forward direction through the film stretching machine, and then in the transverse direction. Forward stretching of the extrudate is conveniently effected over a set of rotating rolls or between two pairs of nip rolls, transverse stretching then being effected in a stenter apparatus. Stretching is effected to an extent determined by the nature of the film-forming polymer, for example—a polyester is usually stretched so that the dimension of the oriented polyester film is from 2.5 to 4.5 its original dimension in the, or each, direction of stretching.

A stretched film may be, and preferably is, dinensionally stabilised by heat-setting under dimensional restraint at a temperature above the glass transition temperature of the film-forming polymer but below the melting temperature thereof, to induce crystallisation of the polymer.

In a preferred embodiment of the invention, the receiver sheet comprises an opaque substrate. Opacity depends, inter alia, on the film thickness and filler content, but an opaque substrate film will preferably exhibit a Transmission Optical Density (Sakura Densitometer: type PDA 65; transmission mode) of from 0.75 to 1.75, and particularly of from 1.2 to 1.5.

A receiver sheet substrate is conveniently rendered opaque by incorporation into the film-forming synthetic polymer of an effective amount of an opacifying agent. However, in a further preferred embodiment of the invention the opaque substrate is voided, as hereinbefore defined. It is therefore preferred to incorporate into the polymer an effective amount of an agent which is capable of generating an opaque, voided substrate structure. Suitable voiding agents, which also confer opacity, include an incompatible resin filler, a particulate inorganic filler or a mixture of two or more such fillers.

By an "incompatible resin" is meant a resin which either does not melt, or which is substantially immiscible with the polymer, at the highest temperature encountered during extrusion and fabrication of the film. Such resins include polyamides and olefin polymers, particularly a homo- or co-polymer of a mono-alpha-olefin containing up to 6 carbon atoms in its molecule, for incorporation into polyester films, or polyesters of the kind hereinbefore described for incorporation into polyolefin films.

Particulate inorganic fillers suitable for generating an opaque, voided substrate include conventional inorganic pigments and fillers, and particularly metal or metalloid oxides, such as alumina, silica and titania, and alkaline earth metal salts, such as the carbonates and sulphates of calcium and barium. Barium sulphate is a particularly preferred filler which also functions as a voiding agent.

Suitable fillers may be homogeneous and consist essentially of a single filler material or compound, such as titanium dioxide or barium sulphate alone. Alternatively, at least a proportion of the filler may be heterogeneous, the primary filler material being associated with an additional modifying component. For example, the primary filler particle may be treated with a surface modifier, such as a pigment, soap, surfactant, coupling agent or other modifier to promote or alter the degree to which the filler is compatible with the substrate polymer.

Production of a substrate having satisfactory degrees of opacity, voiding and whiteness requires that the filler should be finely-divided and the average particle size thereof is desirably from 0.1 to 10 μm provided that the actual particle size of 99.9% by number of the particles does not exceed 30 μm. Preferably, the filler has an average particle size of from 0.1 to 1.0 μm, and particularly preferably from 0.2 to 0.75 μm. Decreasing the particle size improves the gloss of the substrate.

Particle sizes may be measured by electron microscope, coulter counter or sedimentation analysis and the average particle size may be determined by plotting a cumulative distribution curve representing the percentage of particles below chosen particle sizes.

It is preferred that none of the filler particles incorporated into the film support according to this invention should have an actual particle size exceeding 30 μm. Particles exceeding such a size may be removed by sieving processes which are known in the art. However, sieving operations are not always totally successful in eliminating all particles greater than a chosen size. In practice, therefore, the size of 99.9% by number of the particles should not exceed 30 μm. Most preferably the size of 99.9% of the particles should not exceed 20 μm.

Incorporation of the opacifying/voiding agent into the polymer substrate may be effected by conventional techniques—for example, by mixing with the monomeric reactants from which the polymer is derived, or by dry blending with the polymer in granular or chip form prior to formation of a film therefrom.

The amount of filler, particularly of barium sulphate, incorporated into the substrate polymer desirably should be not less than 5% nor exceed 50% by weight, based on the weight of the polymer. Particularly satisfactory levels of opacity and gloss are achieved when the concentration of filler is from about 8 to 30%, and especially from 15 to 20%, by weight, based on the weight of the substrate polymer.

Other additives, generally in relatively small quantities, may optionally be incorporated into the film substrate. For example, china clay may be incorporated in amounts of up to 25% to promote voiding, optical brighteners in amounts up to 1500 parts per million to promote whiteness, and dyestuffs in amounts of up to 10 parts per million to modify colour, the specified concentration being by weight, based on the weight of the substrate polymer.

Thickness of the substrate may vary depending on the envisaged application of the receiver sheet but, in general, will not exceed 250 μm, and will preferably be in a range from 50 to 190 μm.

A receiver sheet having a substrate of the kind hereinbefore described offers numerous advantages including (1) a degree of whiteness and opacity essential in the production of prints having the intensity, contrast and feel of high quality art-work, (2) a degree of rigidity and stiffness contributing to improved resistance to surface deformation and image strike-through associated with contact with the print-head, and (3) a degree of stability, both thermal and chemical, conferring dimensional stability and curl-resistance.

When TTP is effected directly onto the surface of a voided substrate of the kind hereinbefore described, the optical density of the developed image tends to be low and the quality of the resultant print is generally inferior. A receiving layer is therefore required on at least one surface of the substrate, and desirably exhibits (1) a high receptivity to dye thermally transferred from a donor sheet, (2) resistance to surface deformation from contact with the thermal print-head to ensure the production of an acceptably glossy print, and (3) the ability to retain a stable image.

A receiving layer satisfying the aforementioned criteria comprises a dye-receptive, synthetic thermoplastics polymer. The morphology of the receiving layer may be varied depending on the required characteristics. For example, the receiving polymer may be of an essentially amorphous nature to enhance optical density of the transferred image, essentially crystalline to reduce surface deformation, or partially amorphous/crystalline to provide an appropriate balance of characteristics.

The thickness of the receiving layer may vary over a wide range but generally will not exceed 50 μm. The dry thickness of the receiving layer governs, inter alia, the optical density of the resultant image developed in a particular receiving polymer, and preferably is within a range of from 0.5 to 25 μm. In particular, it has been observed that by careful control of the receiving layer thickness to within a range of from 0.5 to 10 μm, in association with an opaque/voided polymer substrate layer of the kind herein described, a surprising and significant improvement in resistance to surface deformation is achieved, without significantly detracting from the optical density of the transferred image.

A dye-receptive polymer for use in the receiving layer, and offering adequate adhesion to the substrate layer, suitably comprises a polyester resin, particularly a copolyester resin derived from one or more dibasic aromatic carboxylic acids, such as terephthalic acid, isophthalic acid and hexahydroterephthalic acid, and one or more glycols, such as ethylene glycol, diethylene glycol, triethylene glycol and neopentyl glycol. Typical copolyesters which provide satisfactory dye-receptivity and deformation resistance are those of ethylene terephthalate and ethylene isophthalate, especially in the molar ratios of from 50 to 90 mole % ethylene terephthalate and correspondingly from 50 to 10 mole % ethylene isophthalate. Preferred copolyesters comprise from 65 to 85 mole % ethylene terephthalate and from 35 to 15 mole % ethylene isophthalate especially a copolyester of about 82 mole % ethylene terephthalate and about 18 mole % ethylene isophthalate.

Formation of a receiving layer on the substrate layer may be effected by conventional techniques—for example, by casting the polymer onto a preformed substrate layer. Conveniently, however, formation of a composite sheet (substrate and receiving layer) is effected by coextrusion, either by simultaneous coextrusion of the respective film-forming layers through independent orifices of a multi-orifice die, and thereafter uniting the still molten layers, or, preferably, by single-channel coextrusion in which molten streams of the respective polymers are first united within a channel leading to a die manifold, and thereafter extruded together from the die orifice under conditions of streamline flow without intermixing thereby to produce a composite sheet.

A coextruded sheet is stretched to effect molecular orientation of the substrate, and preferably heat-set, as hereinbefore described.

Generally, the conditions applied for stretching the substrate layer will induce partial crystallisation of the receiving polymer and it is therefore preferred to heat set under dimensional restraint at a temperature selected to develop the desired morphology of the receiving layer. Thus, by effecting heat-setting at a temperature below the crystalline melting temperature of the receiving polymer and permitting or causing the composite to cool, the receiving polymer will remain essentially crystalline. However, by heat-setting at a temperature greater than the crystalline melting temperature of the receiving polymer, the latter will be rendered essentially amorphous. Heat-setting of a receiver sheet comprising a polyester substrate and a copolyester receiving layer is conveniently effected at a temperature within a range of from 175° to 200° C. to yield a substantially crystalline receiving layer, or from 200° to 250° C. to yield an essentially amorphous receiving layer.

The backing layer of a receiver sheet according to the invention comprises an effective amount of a particulate material to improve the slip, antiblocking and general handling characteristics of the sheet. Such a slip agent may comprise any particulate material which does not film-form during film processing subsequent to formation of the backing layer, for example—an inorganic material such as silica, alumina, china clay and calcium carbonate, or an organic polymer having a high glass transition temperature ($Tg \geqq 75°$ C.), for example—polymethyl methacrylate or polystyrene. The preferred slip agent is silica which is preferably employed as a colloidal sol, although a colloidal alumina sol is also suitable. A mixture of two or more particulate slip agents may be employed, if desired.

The mean particulate size, measured—for example, by photon correlation spectroscopy, of the slip agent is from 5 to 250 nanometers (nm) preferably from 5 to 150 nm. Particularly desirable sheet feeding behaviour is observed when the slip agent comprises a mixture of small and large particles within the size range of from 5 to 150 nm, particularly a mixture of small particles of average diameter from 5 to 50 nm, preferably from 20 to 35 nm, and large particles of average diameter from 70 to 150 nm, preferably from 90 to 130 nm.

The amount of slip additive is conveniently in a range of from 5 to 50%, preferably from 10 to 40%, of the dry weight of the backing layer. When particles of mixed sizes are employed, the weight ratio of small:large particles is suitably from 1:1 to 5:1, particularly from 2:1 to 4:1.

The thickness of the backing layer may extend over a considerable range, depending on the type of printer and print-head to be employed, but generally will be in a range of from 0.005 to 10 μm. Particularly effective sheet-feeding behaviour is observed when at least some of the slip particles protrude from the free surface of the backing layer. Desirably, therefore, the thickness of the backing layer is from about 0.01 to 1.0 μm, particularly from 0.02 to 0.1 μm.

The polymeric binder resin of the backing layer may be any polymer known in the art to be capable of forming a continuous, preferably uniform, film, to be resistant to the temperatures encountered at the print-head and, preferably, to exhibit optical clarity and be strongly adherent to the supporting substrate.

Suitable polymeric binders include:

(a) "aminoplast" resins which can be prepared by the interaction of an amine or amide with an aldehyde, typically an alkoxylated condensation product of melamine and formaldehyde, e.g. hexamethoxymethylmelamine;

(b) homopolyesters, such as polyethylene terephthlate;

(c) copolyesters, particularly those derived from a sulpho derivative of a dicarboxylic acid such as sulphoterephthalic acid and/or sulphoisophthalic acid;

(d) copolymers of styrene with one or more ethylenically unsaturated comonomers such as maleic anhydride or itaconic acid, especially the copolymers described in British patent specification GB-A-1540067; and particularly (e) copolymers of acrylic acid and/or methacrylic acid and/or their lower alkyl (up to 6 carbon atoms) esters, e.g. copolymers of ethyl acrylate and methyl methacrylate, copolymers of methyl methacrylate/butyl acrylate/acrylic acid typically in the molar proportions 55/27/18% and 36/24;40%, and especially copolymers containing hydrophilic functional groups, such as copolymers of methyl methacrylate and methacrylic acid, and cross-linkable copolymers, e.g. comprising approximate molar proportions 46/46/8% respectively of ethyl acrylate/methyl methacrylate/acrylamide or methacrylamide, the latter polymer being particularly effective when thermoset—for example, in the presence of about 25 weight % of a methylated melamine-formaldehyde resin.

Formation of the backing layer may be effected by techniques known in the art, the layer being conveniently applied to the supporting substrate from a coating composition comprising a solution or dispersion of the resin and slip agent in a volatile medium.

Aqueous coating media may be employed provided the polymeric binder is capable of film formation into a continuous uniform coating, generally when applied from an aqueous dispersion or latex, and this medium is particularly suitable for the formation of an acrylic or methacrylic backing layer.

Alternatively, the volatile liquid medium is a common organic solvent or a mixture of solvents in which the polymeric binder is soluble and is also such that the slip particles do not precipitate from the coating composition. Suitable organic solvents include methanol, acetone, ethanol, diacetone alcohol and 2-methoxy ethanol. Minor amounts of other solvents such as methylene chloride and methyl ethyl ketone may also be used in admixture with such solvents.

The adhesion of a coating composition to the substrate may be improved, if appropriate, by the addition of a known adhesion-promoting agent. The "aminoplast" resins (a) described above are particularly suitable for addition as adhesion-promoting agents. Such agents may be cross-linked if desired by the addition of a cross-linking catalyst and heated to initiate the cross-linking reaction after the application of the coating composition to the substrate surface.

Formation of a backing layer by application of a liquid coating composition may be effected at any convenient stage in the production of the receiver sheet. For example, it is preferred, particularly in the case of a polyester film substrate, the formation of which involves relatively high extrusion and/or treatment temperatures, to deposit the backing layer composition directly onto a surface of a preformed film substrate. In particular, it is preferred to apply the backing composition as an inter-draw coating between the two stages (longitudinal and transverse) of a biaxial film stretching operation.

The applied coating medium is subsequently dried to remove the volatile medium and, if appropriate, to effect cross linking of the binder components. Drying may be effected by conventional techniques—for example, by passing the coated film substrate through a hot air oven. Drying may, of course, be effected during normal post-formation film-treatments, such as heat-setting.

If desired, a receiver sheet according to the invention may additionally comprise an antistatic layer. Such an antistatic layer is conveniently provided on the free surface of the backing layer remote from the receptive layer. Although a conventional antistatic agent may be employed, a polymeric antistat is preferred. A particularly suitable polymeric antistat is that described in our copending application (GB Patent Application No. 8815632.8) the disclosure of which is incorporated herein by reference, the antistat comprising (a) a polychlorohydrin ether of an ethoxylated hydroxyamine and (b) a polyglycol diamine, the total alkali metal content of components (a) and (b) not exceeding 0.5% of the combined weight of (a) and (b).

In a preferred embodiment of the invention a receiver sheet is rendered resistant to ultra violet (UV) radiation by incorporation of a UV stabiliser. Although the stabiliser may be present in any of the layers of the receiver sheet, it is preferably present in the receiving layer. The stabiliser may comprise an independent additive or, preferably, a copolymerised residue in the chain of the receiving polymer. In particular, when the receiving polymer is a polyester, the polymer chain conveniently comprises a copolymerised esterification residue of an aromatic carbonyl stabiliser. Suitably, such esterification residues comprise the residue of a di(hydroxyalkoxy)coumarin—as disclosed in European Patent Publication EP-A-31202, the residue of a 2-hydroxy-di(hydroxyalkoxy)benzophenone—as disclosed in EP-A-31203, the residue of a bis(hydroxyalkoxy)xanth -9-one—as disclosed in EP-A-6686, and, particularly preferably, a residue of a hydroxy-bis(hydroxyalkoxy)-xanth-9-one—as disclosed in EP-A-76582. The alkoxy groups in the aforementioned stabilisers conveniently contain from 1 to 10 and preferably from 2 to 4 carbon atoms, for example—an ethoxy group. The content of esterification residue is conveniently from 0.01 to 30%, and preferably from 0.05 to 10%, by weight of the total receiving polymer. A particularly preferred residue is a residue of a 1-hydroxy-3, 6-bis(hydroxyalkoxy)xanth-9-one.

A receiver sheet in accordance with the invention may, if desired, comprise a release medium present either within the receiving layer or, preferably, as a discrete layer on at least part of the exposed surface of the receiving layer remote from the substrate.

The release medium, if employed, should be permeable to the dye transferred from the donor sheet, and comprises a release agent—for example, of the kind conventionally employed in TTP processes to enhance the release characteristics of a receiver sheet relative to a donor sheet. Suitable release agents include solid waxes, fluorinated polymers, silicone oils (preferably cured) such as epoxy- and/or amino-modified silicone oils, and especially organopolysiloxane resins. An organopolysiloxane resin is particularly suitable for application as a discrete layer on at least part of the exposed surface of the receiving layer.

The release medium may, if desired, additionally comprise a particulate adjuvant. Suitably, the adjuvant comprises an organic or an inorganic particulate material having an average particle size not exceeding 0.75 μm and being thermally stable at the temperatures encountered during the TTP operation.

The amount of adjuvant required in the release medium will vary depending on the required surface characteristics, and in general will be such that the weight ratio of adjuvant to release agent will be in a range of from 0.25:1 to 2.0:1.

To confer the desired control of surface frictional characteristics the average particle size of the adjuvant should not exceed 0.75 μm. Particles of greater average size also detract from the optical characteristics, such as haze, of the receiver sheet. Desirably, the average particle size of the adjuvant is from 0.001 to 0.5 μm, and preferably from 0.005 to 0.2 μm.

The required frictional characteristics of the release medium will depend, inter alia, on the nature of the compatible donor sheet employed in the TTP operation, but in general satisfactory behaviour has been observed with a receiver and associated release medium which confers a surface coefficient of static friction of from 0.075 to 0.75, and preferably from 0.1 to 0.5.

The release medium may be blended into the receiving layer in an amount up to about 50% by weight thereof, or applied to the exposed surface thereof in an appropriate solvent or dispersant and thereafter dried, for example—at temperatures of from 100° to 160° C., preferably from 100° to 120° C., to yield a cured release layer having a dry thickness of up to about 5 μm, preferably from 0.025 to 2.0 μm. Application of the release medium may be effected at any convenient stage in the production of the receiver sheet. Thus, if the substrate of the receiver sheet comprises a biaxially oriented polymeric film, application of a release medium to the surface of the receiving layer may be effected off-line to a post-drawn film, or as an in-line inter-draw coating applied between the forward and transverse film-drawing stages.

If desired, the release medium may additionally comprise a surfactant to promote spreading of the medium and to improve the permeability thereof to dye transferred from the donor sheet.

A release medium of the kind described yields a receiver sheet having excellent optical characteristics, devoid of surface blemishes and imperfections, which is permeable to a variety of dyes, and confers multiple, sequential release characteristics whereby a receiver sheet may be successively imaged with different monochrome dyes to yield a full coloured image. In particular, register of the donor and receiver sheets is readily maintained during the TTP operation without risk of wrinkling, rupture or other damage being sustained by the respective sheets.

Figure 2:
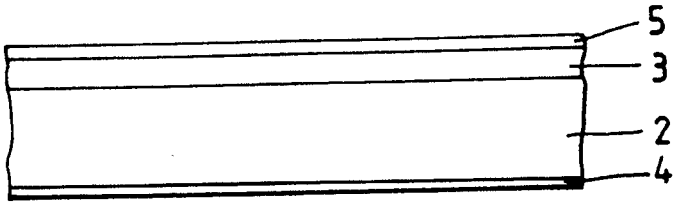
Figure 3:
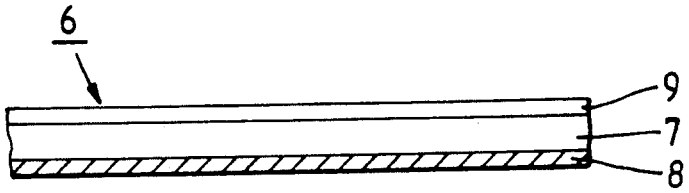
Figure 4:
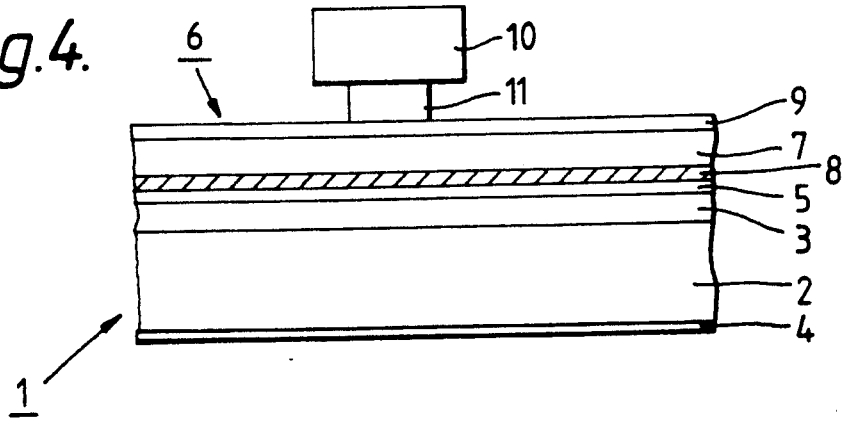
Figure 5:
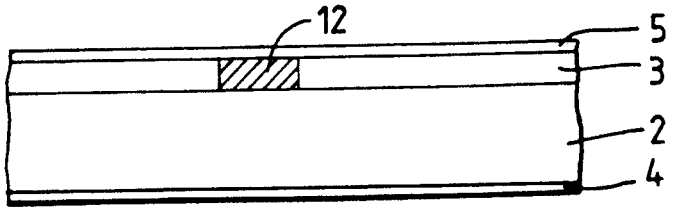

The invention is illustrated by reference to the accompanying drawings in which:

FIG. 1 is a schematic elevation (not to scale) of a portion of a TTP receiver sheet 1 comprising a polymeric supporting substrate 2 having, on a first surface thereof, a dye-receptive receiving layer 3 and, on a second surface thereof, a backing layer 4, FIG. 2 is a similar, fragmentary schematic elevation in which the receiver sheet comprises an independent release layer 5, FIG. 3 is a schematic, fragmentary elevation (not to scale) of a compatible TTP donor sheet 6 comprising a polymeric substrate 7 having on one surface (the front surface) thereof a transfer layer 8 comprising a sublimable dye in a resin binder, and on s second surface (the rear surface) thereof a polymeric protective layer 9, FIG. 4 is a schematic elevation of a TTP process, and FIG. 5 is a schematic elevation of an imaged receiver sheet.

Referring to the drawings, and in particular to FIG. 4, a TTP process is effected by assembling a donor sheet and a receiver sheet with the respective transfer layer 8 and release layer 5 in contact. An electrically-activated thermal print-head 10 comprising a plurality of print elements 11 (only one of which is shown) is then placed in contact with the protective layer of the donor sheet. Energisation of the print-head causes selected individual print-elements 11 to become hot, thereby causing dye from the underlying region of the transfer layer to sublime through dye-permeable release layer 5 and into receiving layer 3 where it forms an image 12 of the heated element(s). The resultant imaged receiver sheet, separated from the donor sheet, is illustrated in FIG. 5 of the drawings.

By advancing the donor sheet relative to the receiver sheet, and repeating the process, a multi-colour image of the desired form may be generated in the receiving layer.

The coefficient of static friction of the backing layer is conveniently determined using a conventional inclined plane assembly, and desirably is within a range of from 0.2 to 0.8, preferably 0.3 to 0.7 and particularly from 0.4 to 0.5.

The invention is further illustrated by reference to the following Examples.

EXAMPLE 1

To prepare a receiver sheet, separate streams of a first polymer comprising polyethylene terephthalate containing 18% by weight, based on the weight of the polymer, of a finely-divided particulate barium. sulphate filler having an average particle size of 0.5 μm and a second polymer comprising an unfilled copolyester of 82 mole % ethylene terephthalate and 18 mole % ethylene isophthalate were supplied from separate extruders to a single-channel coextrusion assembly, and extruded through a film-forming die onto a watercooled rotating, quenching drum to yield an amorphous cast composite extrudate. The cast extrudate was heated to a temperature of about 80° C. and then stretched longitudinally at a forward draw ratio of 3.2:1.

The free surface of the filled polyester layer was then coated with an aqueous coating medium comprising:

| | |
|---|---|
| thermosetting acrylic resin (methyl methacrylate/ethylacrylate/methacrylamide: 46/46/8 molar; with 25% methoxylated melamine-formaldehyde) | 206.5 ml |
| Ammonium nitrate (10% solution) | 5.0 ml |
| 'Ludox' TM (50% w/w aqueous colloidal silica of mean particle size 22 nm, supplied by DuPont) | 13.5 ml |
| 'Synperonic' N (25% w/w aqueous solution of an ethoxylated nonyl phenol, supplied by ICI) | 12.5 ml |
| Demineralised water | to 2500 ml |
| the pH of the mixture being adjusted to 8.5 with N,N-dimethylaminoethanol. | |

The coated, longitudinally stretched film was then heated to a temperature of about 96° C. and stretched transversely in a stenter oven at a draw ratio of 3.4:1. The stretched film was finally heat-set under dimensional restraint in a stenter oven at a temperature of about 225° C.

The resultant sheet comprised an opaque, voided primary substrate layer of filled polyethylene terephthalate of about 150 μm thickness having on one surface thereof a receiving layer of the isophthalate-terephthalate copolymer of about 4 μm thickness, and, on the second surface, a backing layer of about 30 nm thickness. By virtue of the heat-setting temperature employed, the receiving layer was of an essentially amorphous nature.

The backing layer of the receiver sheet had a coefficient of static friction (inclined plane) of about 0.45, and a surface average roughness (Ra) of 0.02 to 0.05 μm. Printer feedability was excellent, individual sheets being easily fed sequentially from a stack (25 sheets: 100×128 mm), without disruption, to the print head of a thermal transfer printer.

EXAMPLE 2

This is a comparative example not according to the invention.

The procedure of Example 1 was repeated except that no backing layer was applied onto the free surface of the polyethylene terephthalate base film.

The free polyethylene terephthalate surface had a coefficient of static friction (inclined plane) greater than 1.4, and a surface average roughness (Ra) value of 0.008 to 0.015 μm. Printer feedability was poor, blocking occurring when attempts were made to feed sequentially a stack (25 sheets: 100×128 mm) of sheets to the print head of a thermal transfer printer.

We claim:

1. A thermal transfer printing receiver sheet for use in association with a compatible donor sheet, the receiver sheet comprising a supporting substrate having on a first surface thereof, a dye-receptive receiving layer to receive a dye thermally transferred from the donor sheet, characterised in that the receiver sheet comprises, on a second surface of said substrate, a backing layer comprising a polymeric resin binder and a non-film-forming inert particulate material of mean particle size from 5 to 250 nm.

2. A receiver sheet according to claim 1 wherein the mean particle size of the particulate material is from 5 to 150 nm.

3. A receiver sheet according to either of claim 1 wherein the particulate material comprises a mixture of small particles, of mean diameter from 5 to 50 nm, and large particles, of mean diameter from 70 to 150 nm.

4. A receiver sheet according to claim 1 wherein the particulate material comprises colloidal silica and/or alumina.

5. A receiver sheet according claim 1 wherein the resin binder comprises a thermosetting acrylic resin.

6. A receiver sheet according claim 1 wherein the substrate contains an effective amount of a voiding agent comprising an incompatible resin filler or a particulate inorganic filler.

7. A receiver sheet according to claim 6 wherein the filler comprises barium sulphate.

8. A receiver sheet according to claim 1 wherein the substrate comprises an oriented thermoplastics polymeric film.

9. A receiver sheet according to claim 1 wherein the dye-receptive polymer comprises a copolyester.

10. A receiver sheet according to claim 1 comprising a release layer on at least part of the surface of the receiving layer remote from the substrate.

11. A receiver sheet according to claim 1 additionally comprising an antistatic layer.

12. A receiver sheet according to claim 11 wherein the antistatic layer comprises (a) a polychlorohydrin ether of an ethoxylated hydroxyamine and (b) a polyglycol diamine, the total alkali metal content of components (a) and (b) not exceeding 0.5% of the combined weight of (a) and (b).

13. A method of producing a thermal transfer printing receiver sheet for use in association with a compatible donor sheet, comprising forming a supporting substrate having, on a first surface thereof, a dye-receptive receiving layer to receive a dye thermally transferred from the donor sheet and, on a second surface thereof, a backing layer comprising a polymeric resin binder and a non-film-forming inert particulate material of mean particle size from 5 to 250 nm.

* * * * *